US005979377A

United States Patent [19]

Barth et al.

[11] Patent Number: 5,979,377

[45] Date of Patent: Nov. 9, 1999

[54] HYDRAULIC SUPPORT ELEMENT FOR A VALVE GEAR MECHANISM OF AN INTERNAL COMBUSTION ENGINE

[75] Inventors: Werner Barth; Arndt Ihlemann, both of Herzogenaurach; Dieter Schmidt, Nürnberg, all of Germany

[73] Assignee: INA Wälzlager Schaffler oHG, Herzogenaurch, Germany

[21] Appl. No.: 09/077,415

[22] PCT Filed: Oct. 24, 1996

[86] PCT No.: PCT/EP96/04619

§ 371 Date: May 28, 1998

§ 102(e) Date: May 28, 1998

[87] PCT Pub. No.: WO97/39223

PCT Pub. Date: Oct. 23, 1997

[30] Foreign Application Priority Data

Apr. 13, 1996 [DE] Germany ..... 196 14 668

[51] Int. Cl.[6] ..... F01L 1/24

[52] U.S. Cl. ..... 123/90.12; 123/90.43; 123/90.45; 123/90.55

[58] Field of Search ..... 123/90.12, 90.51, 123/90.55, 90.56, 90.57, 90.35, 90.43, 90.46, 90.52

[56] References Cited

U.S. PATENT DOCUMENTS

| | | |
|---|---|---|
| 4,098,240 | 7/1978 | Abell, Jr. . |
| 4,584,976 | 4/1986 | Hillebrand . |
| 4,840,153 | 6/1989 | Aida et al. . |
| 4,887,566 | 12/1989 | Shida . |
| 4,920,935 | 5/1990 | Shida . |
| 4,987,672 | 1/1991 | Honda et al. . |
| 5,509,385 | 4/1996 | La Vieri . |

FOREIGN PATENT DOCUMENTS

| | | | |
|---|---|---|---|
| 0 351 033 A1 | 1/1990 | European Pat. Off. . | |
| 0 361 637 A1 | 4/1990 | European Pat. Off. . | |
| 0 411 215 A1 | 2/1991 | European Pat. Off. . | |
| 197811 | 11/1978 | Germany | 123/90.12 |
| 34 09 236 A1 | 9/1985 | Germany . | |
| 36 37 906 A1 | 5/1988 | Germany . | |
| 4318293 | 12/1993 | Germany | 123/90.12 |
| 43 25 610 A1 | 2/1995 | Germany . | |

*Primary Examiner*—Henry C. Yuen
*Assistant Examiner*—Hai Huynh
*Attorney, Agent, or Firm*—Henry M. Feiereisen

[57] ABSTRACT

A sleeve-like element (14) is arranged inside a hydraulic support element to secure against drainage. In axial direction, the sleeve-like inner element (14) bears a shoulder (13) of a piston (4), formed by a rolled-in step (12). In this manner, the inner element (14) can be secured while the piston (4) maintains a uniform wall thickness.

7 Claims, 2 Drawing Sheets

HYDRAULIC SUPPORT ELEMENT FOR A VALVE GEAR MECHANISM OF AN INTERNAL COMBUSTION ENGINE

FIELD OF THE INVENTION

The invention relates to a hydraulic support element for a valve control mechanism of an internal combustion engine, including a piston guided for longitudinal displacement in a housing, with both components enclosing a pressure space which is connected to an antechamber in the piston via a check valve disposed at the lower end of the piston, whereby a sleeve-like element is arranged in the antechamber and supported in axial direction on a shoulder of the piston.

BACKGROUND OF THE INVENTION

A hydraulic support element of this type is known from U.S. Pat. No. 4,584,976 in conjunction with a tappet or a roller tappet. The sleeve-like inner element located in the antechamber has thereby the task to prevent the oil from draining from the antechamber if the support element is in an inclined orientation, whereby the sleeve-like inner element is supported by a shoulder of the piston, with the shoulder being formed by a diametrical constriction of the piston.

There is a drawback, however, that as a consequence of the diametrical constriction, i.e. to provide the piston with different inside diameters, the fabrication of the piston becomes very complex and is possible only by a material-removing process.

SUMMARY OF THE INVENTION

It is the object of the invention to develop a less cost-intensive retention for the sleeve-like inner element in the antechamber, obviating the afore-stated drawback.

This object of the invention is solved in that the shoulder is formed by a rolled-in step in the piston.

The shoulder supporting the sleeve-like inner element is thus fabricated by a non-cutting procedure, i.e. the piston has different inside diameters over its entire length, but the wall thickness of the piston remains unchanged. Consequently, the complicated material-removing manufacture of the piston for forming the different inside diameters for the shoulder is eliminated.

Several other types of attachments of the sleeve-like inner element to the piston are possible.

In accordance with one embodiment of the present invention, the unhardened sleeve-like inner element is press-fitted into the hardened piston. According to another embodiment of the present invention, the unhardened sleeve-like inner element should be swaged in the piston, and both components are hardened together. According to another embodiment of the present invention, the unhardened sleeve-like inner element is rolled-in into a groove of the hardened piston. According to another embodiment of the present invention, the unhardened sleeve-like inner element is secured to the piston with a retainer ring. Finally, according to a further development, the sleeve-like inner element is glued or welded to the piston.

Certainly, the sleeve-like inner element can be restrained and secured in the piston by methods other than those described in the dependent claims. Any type of attachment known to the skilled artisan can be employed which permits hardening of the sleeve-like inner element and/or the piston.

The invention will be described in more detail with reference to the following exemplary embodiment.

BRIEF DESCRIPTION OF THE DRAWING

It is shown in.

DETAILED DESCRIPTION OF THE DRAWING

Figure 1:
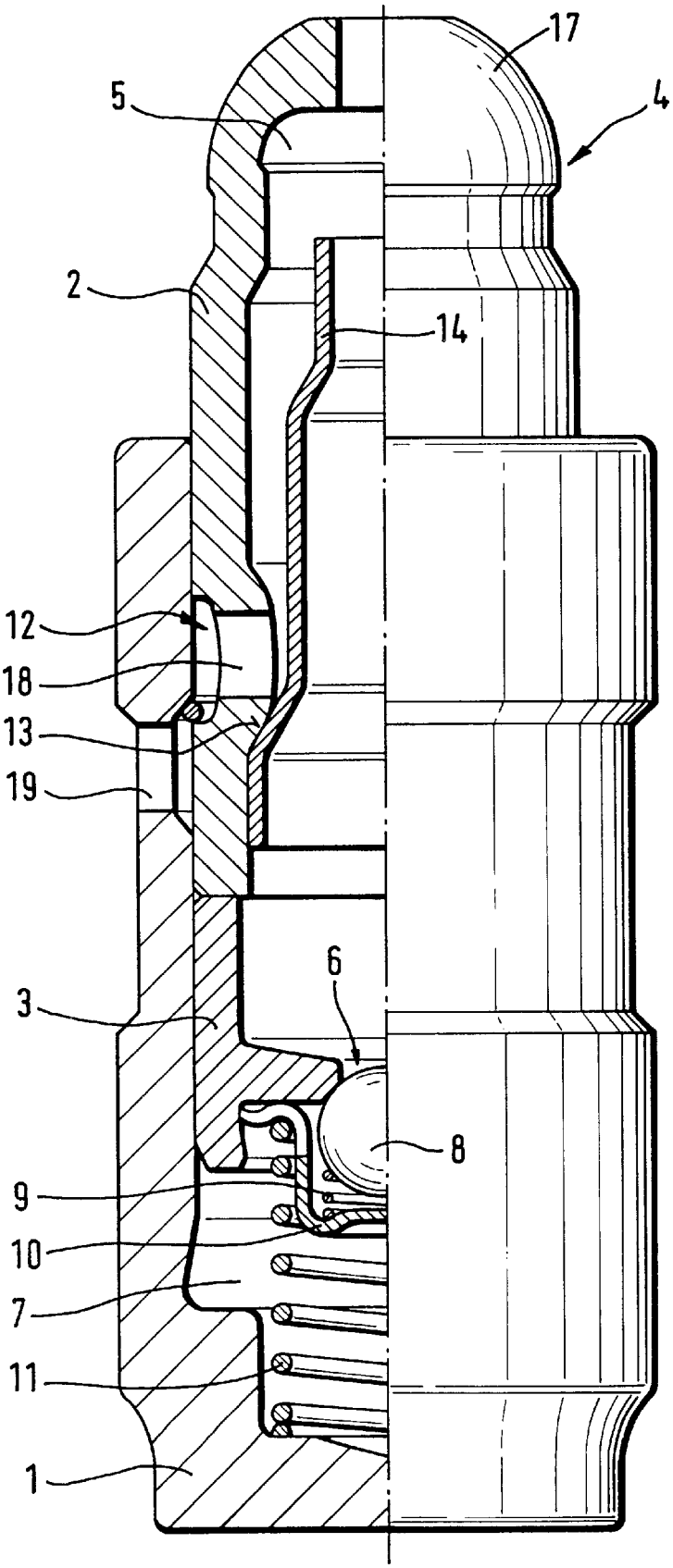
FIG. 1 a partial section of a side view of a hydraulic support element.

The hydraulic support element depicted in FIG. 1 is part of a valve drive (not shown) wherein the support element is operatively connected via a finger lever to a gas exchange valve. The support element essentially includes a housing 1 in the form of a hollow cylinder, in which a piston 4 comprised of an upper piston part 2 and a lower piston part 3 is slideably guided. The piston 4 is also formed as hollow body. Inside the piston 4 there is located an antechamber 5 which is connected via a bore 6 to a pressure space 7 enclosed between the lower piston part 3 and the housing 1. The connection between the antechamber 5 and the pressure space 7 is controlled by a check valve which includes a ball 8, a spring 9 and a valve cap 10 adapted to receive the two components. The valve cap 10 is biased toward the lower piston part 3 by a helical spring 11 which is disposed in the pressure space 7 for returning the piston 4.

The upper piston part 2 terminates in a spherical head 17 which is received in a socket (not shown) of the aforementioned finger lever. The upper piston part 2 and the housing 1 are formed with radial bores 18, 19 for providing a passage for oil to the antechamber 5.

The upper piston part 2 has a rolled-in step 12 which forms a shoulder 13 for supporting a sleeve-like inner element 14 in the axial direction. As is further illustrated in FIG. 1, the wall thickness of the upper piston part 2 is the same over the entire axial length, i.e. the different inside diameters and the shoulder 13 are not realized by varying material thicknesses of the upper piston part 2, as described in the state of the art.

Figure 2:
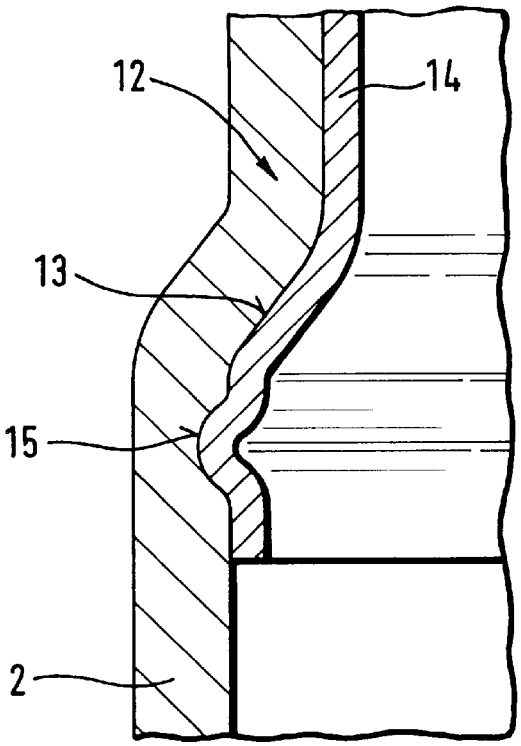
FIGS. 2 and 3 a variation of attachment of the sleeve-like inner element.
Figure 3:
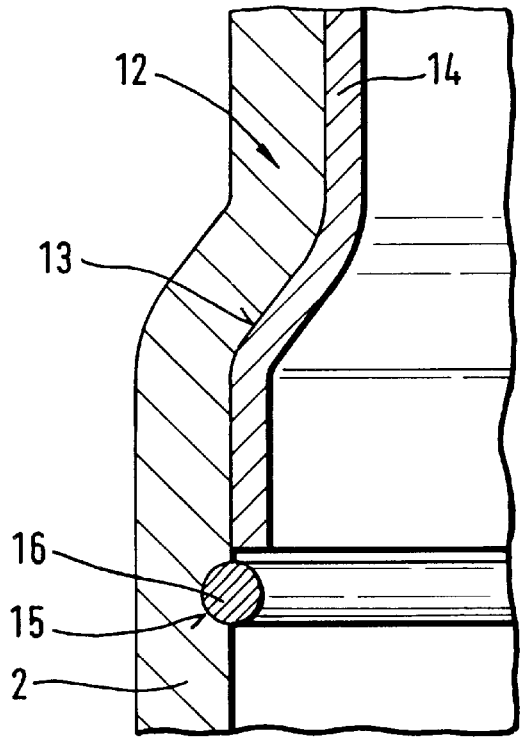

FIGS. 2 and 3 illustrates two possibilities for securing the sleeve-like inner element 14 in the upper piston section 2. In the first example, the sleeve-like inner element 14 is rolled-in into a groove 15 of the upper piston part 2, whereas in the second example the inner element 14 is held by a retainer ring 16 which snaps into the groove 15.

What is claimed is:

1. A hydraulic support element for a valve control mechanism of an internal combustion engine, comprising:

a housing;

a piston received in the housing at formation of a pressure space and guided for longitudinal displacement in the housing, said piston having interiorly a shoulder formed by a rolled-in step of the piston;

a check valve positioned at a lower end of the piston for controlling a passageway between the pressure space and an antechamber provided in the piston; and a sleeve-like inner element accommodated in the antechamber and supported in an axial direction by the shoulder.

2. The hydraulic support element of claim 1 wherein the inner element is made of unhardened material and the piston is made of hardened material, said inner element being press-fitted into the piston.

3. The hydraulic support element of claim 1 wherein the inner element is made of unhardened material and the piston is made of hardened material, said inner element being swaged into the piston, with the piston and the inner element being hardened together.

4. The hydraulic support element of claim 1 wherein the inner element is made of unhardened material and the piston is made of hardened material, said inner element being rolled-in into a groove of the piston.

5. The hydraulic support element of claim 1 wherein the inner element is made of unhardened material and the piston is made of hardened material, and further comprising a retainer ring for holding the inner element in the piston.

6. The hydraulic support element of claim 1 wherein the inner element is glued the piston.

7. The hydraulic support element of claim 1 wherein the inner element is welded to the piston.

* * * * *